US011008742B2

(12) United States Patent
Piquant

(10) Patent No.: US 11,008,742 B2
(45) Date of Patent: May 18, 2021

(54) TECHNOLOGIES FOR PLUNGING

(71) Applicant: Jean Andre Piquant, Bronx, NY (US)

(72) Inventor: Jean Andre Piquant, Bronx, NY (US)

( * ) Notice: Subject to any disclaimer, the term of this patent is extended or adjusted under 35 U.S.C. 154(b) by 74 days.

(21) Appl. No.: 16/564,445

(22) Filed: Sep. 9, 2019

(65) Prior Publication Data

US 2020/0002927 A1 Jan. 2, 2020

Related U.S. Application Data

(62) Division of application No. 15/643,339, filed on Jul. 6, 2017, now Pat. No. 10,415,220.

(51) Int. Cl.

| | |
|---|---|
| ***E03C 1/308*** | (2006.01) |
| ***A41D 19/00*** | (2006.01) |
| ***A47L 13/19*** | (2006.01) |
| ***A47K 7/02*** | (2006.01) |

(52) U.S. Cl.

CPC ..... *E03C 1/308* (2013.01); *A41D 19/0024* (2013.01); *A41D 19/0037* (2013.01); *A41D 19/0079* (2013.01); *A47K 7/02* (2013.01); *A47L 13/19* (2013.01)

(58) Field of Classification Search

CPC ..... A41D 19/0055; A41D 19/0082; A41D 19/01; A41D 19/0024; A41D 19/0037; A41D 19/0079; A47K 7/02; A47K 7/03; A47L 13/19; A47L 13/18; E03C 1/308

See application file for complete search history.

(56) References Cited

U.S. PATENT DOCUMENTS

| | | | |
|---|---|---|---|
| 1,298,139 | A | 3/1919 | Wolcott |
| 1,575,102 | A | 3/1926 | Fiset et al. |
| 3,203,006 | A | 8/1965 | Shirey et al. |
| 4,144,598 | A | 3/1979 | Li |
| D280,053 | S | 8/1985 | Singer |
| 4,670,909 | A | 6/1987 | Forrester |
| 4,846,429 | A | 7/1989 | Scheurer et al. |
| 5,025,502 | A | 6/1991 | Raymond et al. |
| 5,169,251 | A | 12/1992 | Davis |
| D352,968 | S | 11/1994 | Yu |
| 5,454,779 | A | 10/1995 | Lurie et al. |
| 6,055,669 | A | 5/2000 | Albert |
| 6,081,928 | A | 7/2000 | Bourne |
| 6,182,293 | B1 | 2/2001 | Mustin |
| 6,375,143 | B1 | 4/2002 | Burns |
| 6,427,248 | B1 | 8/2002 | Albert |
| 6,732,385 | B1 | 5/2004 | Henderson et al. |
| 7,832,019 | B1 | 11/2010 | Bhalla |
| 7,946,739 | B2 | 5/2011 | Shayne |
| 8,225,425 | B2 | 7/2012 | Polucha et al. |
| 2001/0044950 | A1 | 11/2001 | Sajovic |
| 2004/0255361 | A1 | 12/2004 | Senter et al. |
| 2005/0193515 | A1 | 9/2005 | Chang |
| 2008/0134421 | A1 | 6/2008 | Sheffield et al. |
| 2015/0082511 | A1 | 3/2015 | Bryant |

FOREIGN PATENT DOCUMENTS

| | | | |
|---|---|---|---|
| EP | 0509773 | | 10/1992 |
| KR | 20100001612 U | * | 2/2010 |

* cited by examiner

*Primary Examiner* — Erin Deery
(74) *Attorney, Agent, or Firm* — Dentons US LLP

(57) ABSTRACT

A glove includes: a palm; a suction cup coupled to the palm; and a suction releaser coupled to the suction cup. A method includes: positioning a suction cup over a drain, with the suction cup being coupled to a palm of a glove; and plunging the drain via the suction cup.

31 Claims, 4 Drawing Sheets

TECHNOLOGIES FOR PLUNGING

CROSS REFERENCE TO RELATED APPLICATIONS

This patent application is a Divisional of U.S. Utility patent application Ser. No. 15/643,339 filed 6 Jul. 2017, which is hereby incorporated by reference for all purposes.

TECHNICAL FIELD

This disclosure relates to plunging drains.

BACKGROUND

A plunger can include a shaft and a suction cup. This structure can make plunging difficult in some circumstances, such as in a sink drain, a toilet drain, a pan drain, a tub drain, or others, whether in a residential, industrial, or commercial setting, whether indoors or outdoors, such as a bathroom, a kitchen, a shower room, or others. Accordingly, there is a desire to improve.

SUMMARY

An embodiment includes a glove comprising: a palm; a suction cup coupled to the palm; and a suction releaser coupled to the suction cup.

An embodiment includes a method comprising: positioning a suction cup over a drain, wherein the suction cup is coupled to a palm of a glove; and plunging the drain via the suction cup.

DETAILED DESCRIPTION

Figure 1:
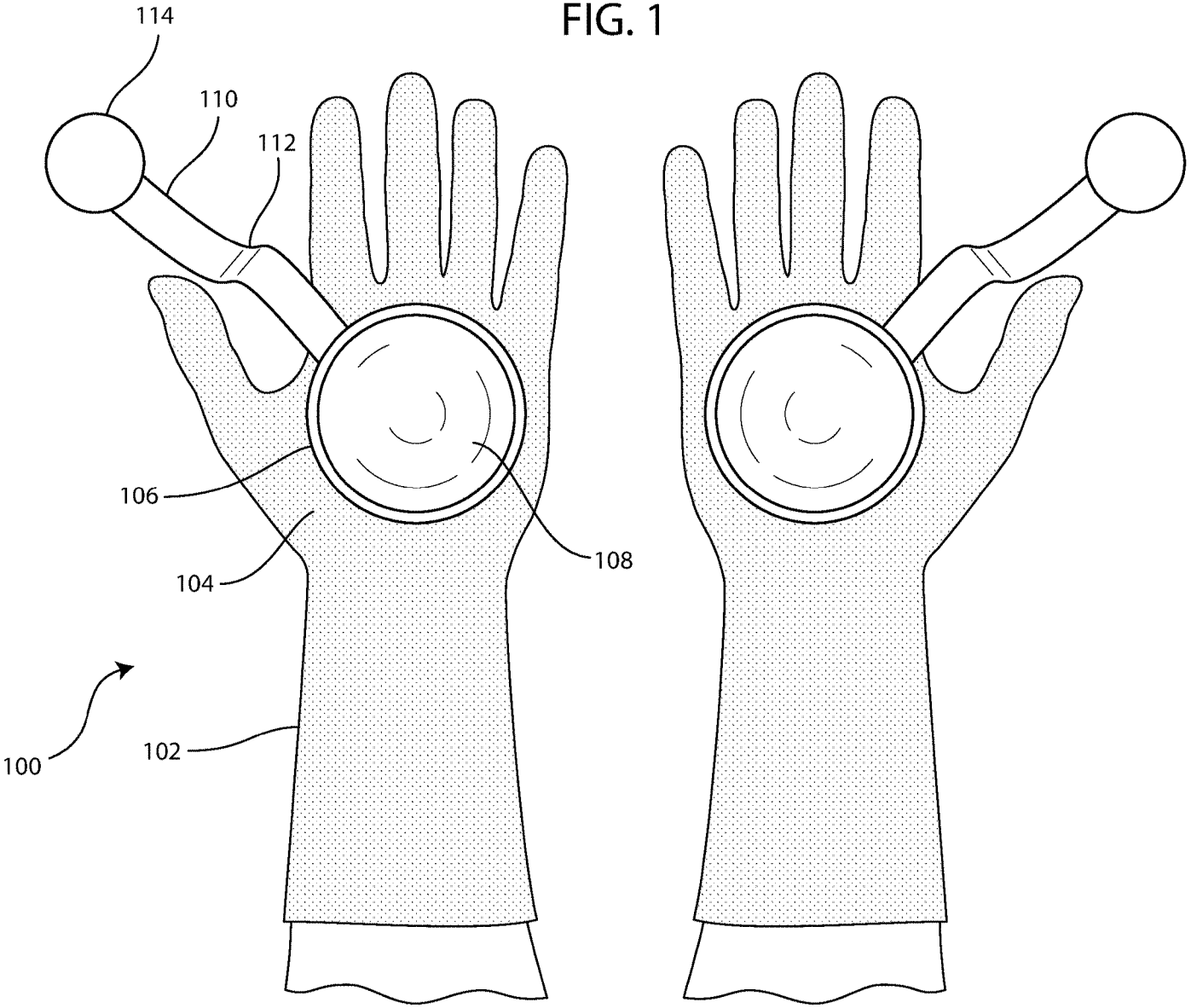
FIG. 1 shows a bottom view of an embodiment of a pair of plunging gloves according to this disclosure.

This disclosure can be embodied in many different forms and should not be construed as necessarily being limited to embodiments, as disclosed herein. Rather, the embodiments are provided so that this disclosure is thorough and complete, and fully conveys various concepts of this disclosure to those skilled in a relevant art.

Features described with respect to certain embodiments can be combined and sub-combined in and/or with various other embodiments. Also, different aspects and/or elements of embodiments, as disclosed herein, can be combined and sub-combined in a similar manner as well. Further, some embodiments, whether individually and/or collectively, can be components of a larger system, wherein other procedures can take precedence over and/or otherwise modify their application. Additionally, a number of steps can be required before, after, and/or concurrently with embodiments, as disclosed herein. Note that any and/or all methods and/or processes, at least as disclosed herein, can be at least partially performed via at least one entity in any manner.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Various terminology used herein is for describing particular embodiments and is not intended to be necessarily limiting of this disclosure. As used herein, various singular forms "a," "an" and "the" are intended to include various plural forms as well, unless a context clearly indicates otherwise. Various terms "comprises," "includes" and/or "comprising," "including" when used in this specification, specify a presence of stated features, integers, steps, operations, elements, and/or components, but do not preclude the presence and/or addition of one or more other features, integers, steps, operations, elements, components, and/or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

Embodiments of this disclosure are described herein with reference to illustrations of idealized embodiments (and intermediate structures) of this disclosure. As such, variations from various illustrated shapes as a result, for example, of manufacturing techniques and/or tolerances, are to be expected. Thus, various embodiments of this disclosure should not be construed as necessarily limited to various particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized and/or overly formal sense unless expressly so defined herein.

Furthermore, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" and/or "substantially" refers to a +/−10% variation from a nominal value/term. Such variation is always included in any given value/term provided herein, whether or not such variation is specifically referred thereto.

Figure 2:
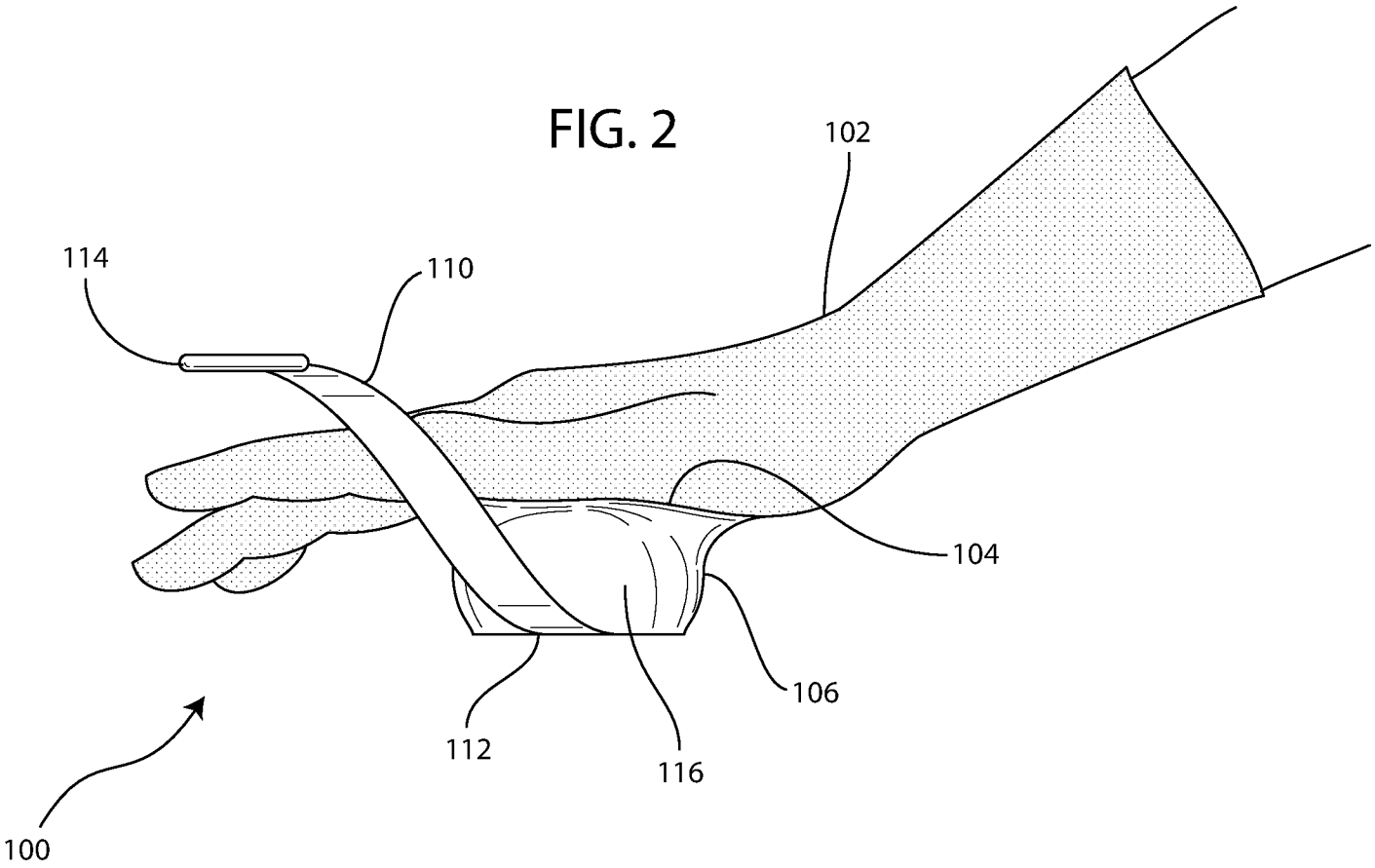
FIG. 2 shows a side view of an embodiment of a plunging glove according to this disclosure.

FIG. 1 shows a bottom view of an embodiment of a pair of plunging gloves according to this disclosure. FIG. 2 shows a side view of an embodiment of a plunging glove according to this disclosure. In particular, a pair of plunging gloves 100 includes a left hand glove 102 and a right hand glove. In some embodiments, the glove 102 can include a mitten. In some embodiments, the glove 102 can be ambidextrous. In some embodiments, the glove 102 can include fingers, such as a finger. In some embodiments, the glove 102 can be fingerless. In some embodiments, the glove 102 can extend up to a wearer's wrist or less. In some embodiments, the glove 102 can extend past the wearer's wrist, such as between the wearer's wrist and the wearer's elbow, or between the wearer's elbow and the wearer's shoulder or be a part of a garment, such as a shirt, a jacket, a hazmat suit, or others. Regardless, the glove 102 can include any material, such as rubber, plastic, fabric, leather, metal, wood, or others.

The glove 102 includes a palm 104, a suction cup 106, and a suction releaser 110. The suction cup 106 is structured for plunging a plumbing drain, such as a sink drain, a toilet drain, a pan drain, a tub drain, or others, whether in a residential, industrial, or commercial setting, whether indoors or outdoors, such as a bathroom, a kitchen, a shower room, or others. For example, the suction cup 106 is structured to form a plunging seal and then enable horizontal, vertical, or diagonal plunging thereby in order to clear a blockage in a plumbing pipe, such as a plastic pipe, a metal pipe, or others extending in any manner in any orientation along any plane. For example, the plastic pipe can include a polyvinyl chloride (PVC) pipe, a cross-linked polyethylene (PEX) pipe, a polyethylene terephthalate (PET) pipe, or others. For example, the metal pipe can include an iron pipe, a copper pipe, a steel pipe, a bronze pipe, an aluminum pipe, or others. For example, the plumbing drain can have a rectangular shape, a square shape, a triangular shape, a circular shape, a pentagonal shape, a hexagonal shape, an oblong shape, a keyhole shape, or others. As such, the suction cup 106 includes a sidewall 116 and a base from which the sidewall 116 extends. The sidewall 116 defines an inner cavity 108, which may be any shape, whether having an open or closed shape, whether symmetric or asymmetric, whether polygonal or non-polygonal, whether uniform or non-uniform, such as a taper, a circle, a square, a triangle, a rectangle, a pentagram, an ovoid, an parallelogram, a pentagon, a hexagon, an oblong shape, a keyhole shape, or others. For example, the inner cavity 116 can be volumetrically sized to contain from about 0 cups to about 10 cups of a liquid, such as water, although higher amounts are possible as well. In some embodiments, the suction cup 106 lacks the base, such as when the suction cup 106 is tubular, and, instead, the palm 104 is the base. In some embodiments, the base or the sidewall 116 can host a honeycomb pattern. The sidewall 116 or the base include compressible rubber or another suitable material. For example, the sidewall 116 can be structured for uniform or non-uniform compression. The sidewall 116 can be configured for telescoping or nesting. For example, the sidewall 116 can be beehive-shaped, flanged, step-down tiered, or others. For example, when the suction cup 106 is beehive-shaped, then, in order to make a tight seal again a plumbing drain, the sidewall 116 can include a soft, pliable rubber at a lower portion, which may be bulbous, a stiffer midsection, which may be ringed for stability and minimize a chance of the suction cup 106 collapsing onto itself, and a thicker upper portion near the palm 104. For example, the suction cup 106 can be shaped to look like a rubber ball cut in half with a flared edge or the suction cup 106 can be shaped to look like a distorted ball, tapered on one half, with a large hole on bottom. In some embodiments, the suction cup 106 is flangeless.

The suction cup 106 is coupled to the palm 104, whether being unitary therewith or assembled therewith. For example, the suction cup 106 can be unitary with the palm 104, such as when the suction cup 106, such as the base or the sidewall 116, and the palm 104 are manufactured from a same material, such as rubber or others. For example, the suction cup 106 can be assembled with the palm 104, such as via fastening, mating, interlocking, adhering, stapling, brazing, or others. For example, the suction cup 106 can be permanently attached to the palm 104, such as when the suction cup 106 and the palm 104 are manufactured from a same material, such as rubber or others, or the suction cup 106 can be selectively detachable from the palm 104, such as when the suction cup 106 is threaded, hook-and-looped, mated, interlocked, or others onto the palm 104. For example, the suction cup 106 can be permanently attached to the palm 104 via the base or the sidewall 116. For example, the suction cup 106 can be selectively detachable from the palm 104 via the base or the sidewall 116. Note that although FIGS. 1 and 2 show the palm 104 having only one suction cup 106 coupled thereto, this structure can vary, such as when the palm 104 is coupled to a plurality of suction cups 106, such as for suctioning onto a surface, such as a surface of an item, such as a kitchenware item, a medical item, or others. In some embodiments, the sidewall 116 can host a coupling surface, such as a magnet or others. For example, a lowermost end portion of the sidewall 116 can host the coupling surface, such as for coupling to a drip tray.

The suction releaser 110 is coupled to the suction cup 106, whether being unitary therewith or assembled therewith. For example, the suction cup 106 can be unitary with the suction releaser 110, such as when the suction cup 106, such as the base or the sidewall 116, and the suction releaser 110 are manufactured from a same material, such as rubber or others. For example, the suction cup 106 can be assembled with the suction releaser 110, such as via fastening, mating, interlocking, adhering, stapling, brazing, or others. For example, the suction cup 106 can be permanently attached to the suction releaser 110, such as when the suction cup 106 and the suction releaser 110 are manufactured from a same material, such as rubber or others, or the suction cup 106 can be selectively detachable from the suction releaser 110, such as when the suction cup 106 is threaded, hook-and-looped, mated, interlocked, or others onto the suction releaser 110. For example, the suction cup 106 can be permanently attached to the suction releaser 110 via the base or the sidewall 116. For example, the suction cup 106 can be selectively detachable from the suction releaser 110 via the base or the sidewall 116. Note that although FIGS. 1 and 2 show the suction cup 106 having only one suction releaser 110 coupled thereto, this structure can vary, such as when the suction cup 106 is coupled to a plurality of suction releasers 110, such as for enhancing suction release. For example, a lowermost end portion of the sidewall 116 can host the suction releasers 110 such that the suction releasers 110 are spaced apart from each other, such as diametrically, radially, or other ways.

The suction releaser 110 is used to release a suction after plunging via the suction cup 106. As such, the suction releaser 110 can include at least one of a tab, a string, a chain, a cable, a band, a belt, a valve, a bar, or any other structure, which may include metal, plastic, rubber, wood, leather, or others, that enables a release of the suction from the suction cup 106, such as via pulling away from the drain over which the suction cup 106 is positioned. For example, the band may be elastic. When the suction releaser 110 includes the bar, which may be rigid, then the bar can be at least one of planar, flat, hollow, solid, perforated, tubular, cylindrical, or others. In some embodiments, the bar can include a bend 112, which may enable the bar to operate as a lever against a surface, such as a sink bottom, a pan bottom, a tub bottom, a toilet wall, or others. Note that the bend 112 can be at any angle sufficient to enable to the bar to operate as the lever against the surface. For example, such angle may be from about 0 degrees to about 180 degrees. Note that in order to assist the wearer of the glove 102 in releasing the suction, the suction releaser 110 can host a handle 114, whether unitary thereto or assembled therewith, which may be of any type and can include any material, as disclosed herein. Although FIGS. 1 and 2 show the handle 114 to be a circular plate, other shapes are possible, such as a loop, a sphere, an ovoid, a hook, or others.

In some embodiments, the glove 102 may host or include an input device, such as a camera, a microphone, or others. For example, the camera can include an optical camera, an infrared camera, or others. The palm 104 or the suction cup 106 can include a lens in order to see into a plumbing drain. For example, the inner cavity 108 can enclose the lens, which may be centrally positioned on the base. The camera is powered via a power source, which may be local to or remote from the glove 102.

In some embodiments, the suction cup 106 may be in communication with a reservoir of a fluid such that the suction cup 106 can output the fluid, whether a liquid or a gas. For example, the suction cup 106, such as the base or the sidewall 116, can include an opening through which the fluid can enter, which may be under pressure. For example, the fluid may be a chemical drain cleaner, a hot, such as over 115 degrees Fahrenheit, or boiling liquid, such as water, or others. As such, since the glove 102 includes a shell that includes the palm 104, then at least one of the shell or the suction cup 106 can host the reservoir, although note that the reservoir can be hosted local to or remote from the glove 102.

Figure 4:
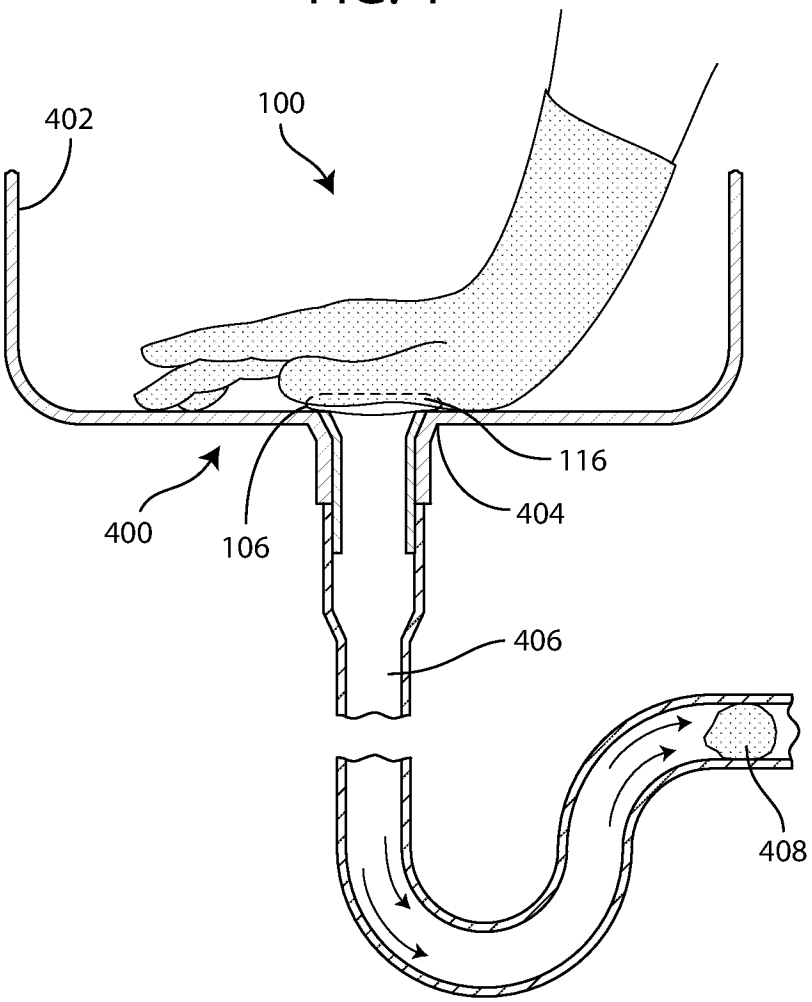
FIG. 4 shows a side view of an embodiment of a plunging glove after plunging a sink according to this disclosure.
Figure 3:
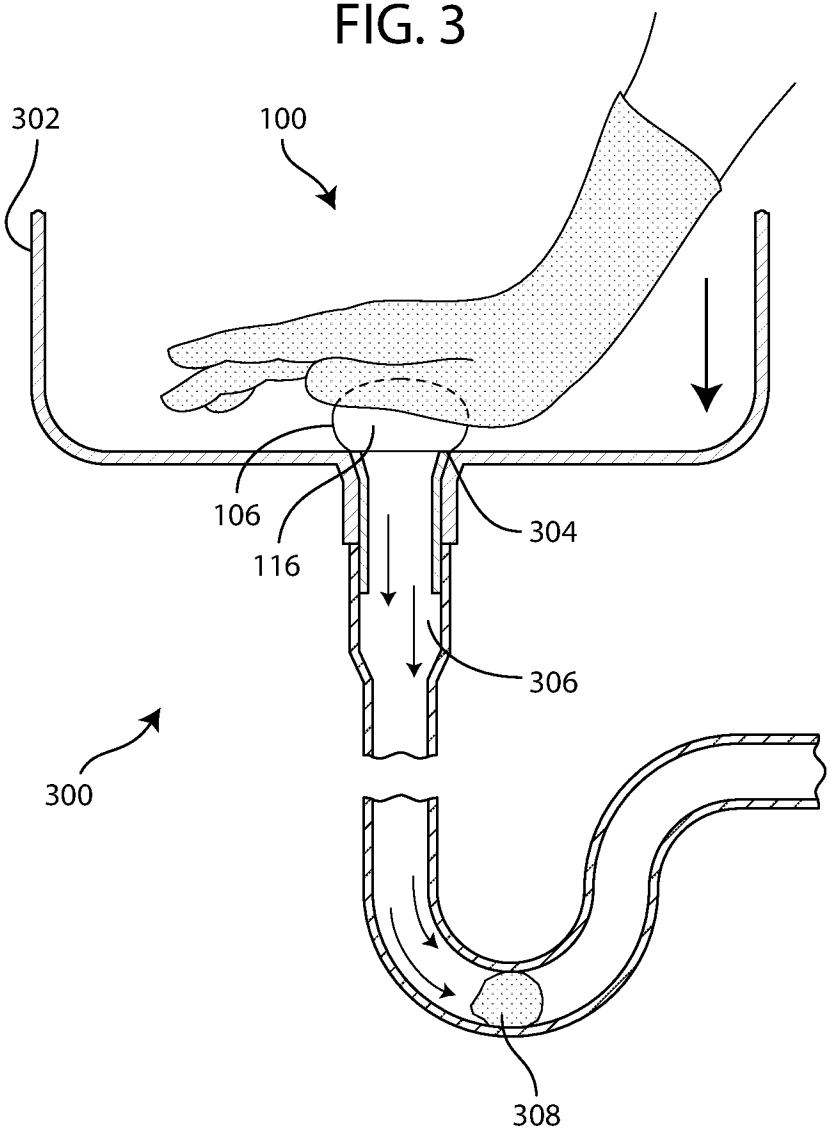
FIG. 3 shows a side view of an embodiment of a plunging glove before plunging a sink according to this disclosure.

FIG. 3 shows a side view of an embodiment of a plunging glove before plunging a sink according to this disclosure. FIG. 4 shows a side view of an embodiment of a plunging glove after plunging a sink according to this disclosure. In particular, FIG. 3 shows a state of being 300, where the suction cup 106 is positioned to contact a bottom inner side of a sink 302, over a plumbing drain 304, which is in fluid communication with a plumbing pipe 306 containing a blockage 308, such as a tissue, such that a plunging seal is formed via the suction cup 106. Note that the suction cup 106 is not yet plunged and the sidewall 116 is in a non-compressed state such that the inner cavity 108 is able to enclose a volume of a fluid. As shown in FIG. 4, in a state of being 400, the wearer of the glove 102 has applied a downward pressure onto the palm 104 such that the sidewall 116, while in contact with a bottom inner side of a sink 402 and during a plunging seal, over a plumbing drain 404, collapsibly compresses over the plumbing drain 404 and thereby the base applies a force of a fluid along a plumbing tube 406 to move a blockage 408 along the plumbing tube 406 through a positive or negative pressure such that at this state the inner cavity 108 is not able to enclose a volume of fluid.

Figure 5:
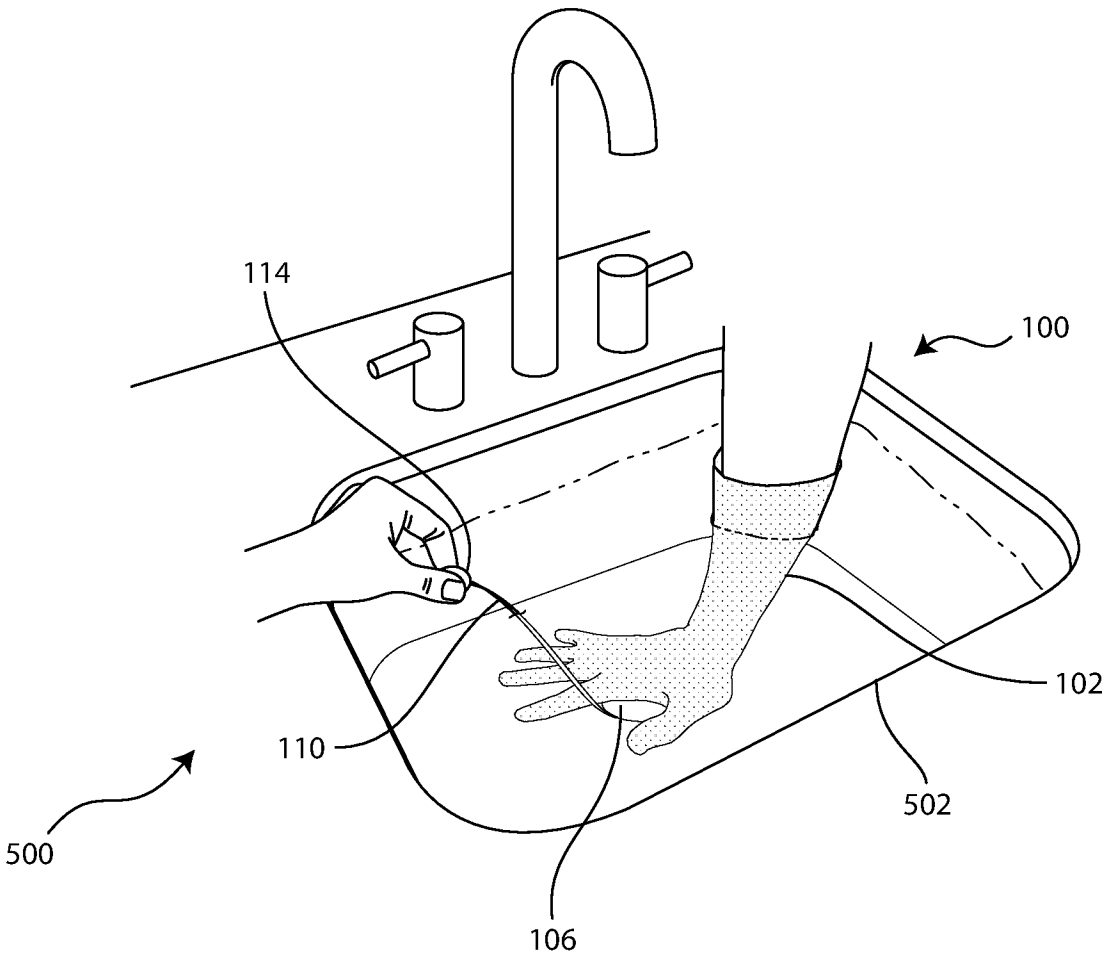
FIG. 5 shows a perspective view of an embodiment of a suction releaser relieving a suction from a suction cup of a plunging glove according to this disclosure.

FIG. 5 shows a perspective view of an embodiment of a suction releaser relieving a suction from a suction cup of a plunging glove according to this disclosure. After a drain has been plunged, such as when a blockage no longer blocks a pipe in fluid communication with the drain, as shown in FIGS. 3-4, in a state of being 500, whether the sidewall 116 is collapsibly compressed or not, the wearer of the glove 102 or a bystander pulls, whether sideways, such as lateral to the glove 102, or upwards, such as away from a sink 502, the suction releaser 110 via grasping the handle 114 such that a portion of the sidewall 116 is lifted to release a suction. For example, the wearer of the glove 102 or the bystander can lift the portion of the suction cup 106 via a suction releaser 110 after the drained has been plunged such that a suction of the suction cup 106 is released.

In some embodiments, the suction cup 106 is more effective with water in a pipe because water does not compress and will thus transmit more of applied force than air. Further, note that the suction 106 can plunge, as disclosed herein, in a sink or a tub that has a drain filtering insert or a garbage disposal unit.

A scope of this disclosure is defined by various claims, which include known equivalents and unforeseeable equivalents at a time of filing of this disclosure. Various corresponding structures, materials, acts, and equivalents of all means or step plus function elements in claims below are intended to include any structure, material, or act for performing a function in combination with other claimed elements as specifically claimed. This disclosure has been presented for purposes of illustration and description, but is not intended to be fully exhaustive and/or limited to disclosure in a form disclosed. Many modifications and variations in techniques and structures will be apparent to skilled artisans without departing from a scope and spirit of this disclosure as set forth in the claims that follow. Accordingly, such modifications and variations are contemplated as being a part of this disclosure.

What is claimed is:

1. A method comprising:

causing a suction cup of a palm of a glove to be positioned over a drain that is clogged with a blockage; and causing the drain to be plunged via the suction cup such that the drain is thereby unclogged from the blockage.

2. The method of claim 1, further comprising:

causing a release of a suction from the suction cup after the drain is unclogged from the blockage.

3. The method of claim 2, wherein the release is via lifting a portion of the suction cup from the drain after the drain is unclogged from the blockage.

4. The method of claim 1, wherein the suction cup is coupled to a suction releaser.

5. The method of claim 4, wherein the suction cup and the suction releaser are unitary and include the same material.

6. The method of claim 4, wherein the suction releaser includes a tab.

7. The method of claim 4, wherein the suction releaser includes a string.

8. The method of claim 4, wherein the suction releaser includes a chain.

9. The method of claim 4, wherein the suction releaser includes a cable.

10. The method of claim 4, wherein the suction releaser includes a band.

11. The method of claim 4, wherein the suction releaser includes a belt.

12. The method of claim 4, wherein the suction releaser includes a valve.

13. The method of claim 4, wherein the suction releaser includes a bar.

14. The method of claim 13, wherein the bar is planar.

15. The method of claim 13, wherein the bar is tubular.

16. The method of claim 13, wherein the bar includes a bend.

17. The method of claim 1, wherein the suction cup is permanently attached to the palm.

18. The method of claim 1, wherein the suction cup is selectively detachable from the palm.

19. The method of claim 1, wherein the palm has only one suction cup coupled thereto.

20. The method of claim 1, wherein the suction cup includes a lens.

21. The method of claim 1, wherein the suction cup is in communication with a reservoir of a fluid such that the suction cup can output the fluid.

22. The method of claim 21, wherein the glove includes a shell, wherein the shell includes the palm, wherein at least one of the shell or the suction cup hosts the reservoir.

23. The method of claim 1, wherein the drain is a sink drain.

24. The method of claim 1, wherein the drain is a toilet drain.

25. The method of claim 1, wherein the drain is a pan drain.

26. The method of claim 1, wherein the drain is a tub drain.

27. The method of claim 1, wherein the suction cup includes a base coupled to the palm.

28. The method of claim 1, wherein the suction cup is flanged.

29. The method of claim 1, wherein the suction cup is step-down tiered.

30. The method of claim 1, wherein the suction cup is shaped as a ball cut in half with a flared edge.

31. The method of claim 1, wherein the suction cup is flangeless.

* * * * *